US011408302B2

(12) United States Patent
Clum et al.

(10) Patent No.: US 11,408,302 B2
(45) Date of Patent: Aug. 9, 2022

(54) FILM COOLING HOLE ARRANGEMENT FOR GAS TURBINE ENGINE COMPONENT

(71) Applicant: United Technologies Corporation, Farmington, CT (US)

(72) Inventors: Carey Clum, East Hartford, CT (US); Dominic J. Mongillo, Jr., West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 439 days.

(21) Appl. No.: 15/783,318

(22) Filed: Oct. 13, 2017

(65) Prior Publication Data

US 2019/0112942 A1 Apr. 18, 2019

(51) Int. Cl.
*F01D 25/12* (2006.01)
*F01D 5/18* (2006.01)
(Continued)

(52) U.S. Cl.
CPC ..... *F01D 25/12* (2013.01); *F01D 5/186* (2013.01); *F01D 5/187* (2013.01); *F01D 9/041* (2013.01);
(Continued)

(58) Field of Classification Search
CPC ..... F01D 5/187; F01D 9/041; F01D 9/065; F01D 5/186; F01D 25/12; F05D 2220/32;
(Continued)

(56) References Cited

U.S. PATENT DOCUMENTS 4,105,364 A 8/1978 Dodd
4,446,693 A * 5/1984 Pidcock ..... F23R 3/002 60/757
(Continued)

FOREIGN PATENT DOCUMENTS

EP 2233693 A1 9/2010
EP 3179041 A1 6/2017
(Continued)

OTHER PUBLICATIONS

European Search Report Issued In EP Application No. 18200554.6, dated Mar. 3, 2019, 12 Pages.

*Primary Examiner* — Courtney D Heinle
*Assistant Examiner* — Andrew Thanh Bui
(74) *Attorney, Agent, or Firm* — Cantor Colburn LLP

(57) ABSTRACT

A component for a gas turbine engine includes an outer surface bounding a hot gas path of the gas turbine engine, and a cooling passage configured to deliver a cooling airflow therethrough. The cooling passage includes a passage wall located opposite the outer surface to define a component thickness and a plurality of protrusions located along the passage wall. Each protrusion has a protrusion height extending from the passage wall and a protrusion streamwise width extending along the passage wall in a flow direction of the cooling airflow through the cooling passage. One or more cooling holes extend from the passage wall to the outer surface. A cooling hole inlet of a cooling hole is located at the passage wall, in a protrusion wake region downstream of a protrusion of the plurality of protrusions.

18 Claims, 5 Drawing Sheets

(51) Int. Cl.
*F01D 9/06* (2006.01)
*F01D 9/04* (2006.01)

(52) U.S. Cl.
CPC ..... *F01D 9/065* (2013.01); *F05D 2220/32* (2013.01); *F05D 2230/21* (2013.01); *F05D 2240/11* (2013.01); *F05D 2250/75* (2013.01); *F05D 2260/201* (2013.01); *F05D 2260/202* (2013.01); *F05D 2260/2212* (2013.01); *F05D 2260/22141* (2013.01)

(58) Field of Classification Search
CPC ..... F05D 2230/21; F05D 2240/11; F05D 2250/75; F05D 2260/201; F05D 2260/202; F05D 2260/2212; F05D 2260/22141; F05D 2240/127
See application file for complete search history.

(56) References Cited

U.S. PATENT DOCUMENTS 5,779,438 A * 7/1998 Wilfert ..... F01D 5/186 415/115
6,224,336 B1 * 5/2001 Kercher ..... F01D 5/186 415/115
6,331,098 B1 * 12/2001 Lee ..... F01D 5/187 416/97 R
6,474,947 B1 11/2002 Yuri
7,232,290 B2 * 6/2007 Draper ..... B23P 15/02 416/97 R
7,665,968 B2 * 2/2010 Mongillo, Jr ..... F01D 5/187 416/97 R
8,083,485 B2 * 12/2011 Chon ..... F01D 5/187 416/97 R
8,757,974 B2 * 6/2014 Propheter-Hinckley ..... F01D 5/186 416/97 R
9,133,717 B2 * 9/2015 Nakamata ..... F01D 5/186
9,314,838 B2 * 4/2016 Pointon ..... F01D 5/187
9,638,057 B2 * 5/2017 Kwon ..... F01D 25/12
10,767,490 B2 * 9/2020 Clum ..... F01D 5/186
2006/0210399 A1 9/2006 Kitamura et al.
2015/0016947 A1 * 1/2015 Kwon ..... F01D 25/12 415/1
2017/0167268 A1 6/2017 Bunker
2018/0163545 A1 * 6/2018 Bang ..... F23R 3/002

FOREIGN PATENT DOCUMENTS

JP 11257005 A 9/1999
JP 2006214324 A * 8/2006
JP 2006214324 A 8/2006

* cited by examiner

FILM COOLING HOLE ARRANGEMENT FOR GAS TURBINE ENGINE COMPONENT

BACKGROUND

Exemplary embodiments pertain to the art of gas turbine engines, and more particularly to cooling of gas turbine engine components.

Gas turbines hot section components, for example, turbine vanes and blades and blade outer air seals, in the turbine section of the gas turbine engine are configured for use within particular temperature ranges. Often, the conditions in which the components are operated exceed a maximum useful temperature of the material of which the components are formed. Thus, such components often rely on cooling airflow to cool the components during operation. For example, stationary turbine vanes often have internal passages for cooling airflow to flow through, and additionally may have openings in an outer surface of the vane for cooling airflow to exit the interior of the vane structure and form a cooling film of air over the outer surface to provide the necessary thermal conditioning. Similar internal cooling passages are often included in other components, such as the aforementioned turbine blades and blade outer air seals.

Internal features such as pedestals and/or pin fins are often included in the cooling passages, affixed to one or more walls of the cooling passage to increase turbulence of the cooling airflow flowing through the cooling passage, thereby improving heat transfer characteristics of the cooling passage. Currently there is a limit for the spacing of the pedestals and pin fins for adjacent rows. This is because for each feature such as a pedestal or pin fin a separation bubble forms on the downstream side of the feature. If the spacing is too close the separation bubble does not close before hitting the next pedestal or pin fin row. This reduces the heat transfer augmentation of the internal features because the strength of the secondary flows formed on the adjacent pedestal or pin fin row (horseshoe vortex) and the velocity coming into the adjacent row is significantly dropped. Again this drastically reduces the effectiveness of the pedestals and/or pin fins, reducing thermal energy transfer from the component to the airflow.

BRIEF DESCRIPTION

In one embodiment, a component for a gas turbine engine includes an outer surface bounding a hot gas path of the gas turbine engine, and a cooling passage configured to deliver a cooling airflow therethrough. The cooling passage includes a passage wall located opposite the outer surface to define a component thickness and a plurality of protrusions located along the passage wall. Each protrusion has a protrusion height extending from the passage wall and a protrusion streamwise width extending along the passage wall in a flow direction of the cooling airflow through the cooling passage. One or more cooling holes extend from the passage wall to the outer surface. A cooling hole inlet of a cooling hole is located at the passage wall, in a protrusion wake region downstream of a protrusion of the plurality of protrusions.

Additionally or alternatively, in this or other embodiments the plurality of protrusions are arranged in a plurality of rows.

Additionally or alternatively, in this or other embodiments a ratio of protrusion streamwise spacing to protrusion hydraulic diameter is 2.5 or less.

Additionally or alternatively, in this or other embodiments the ratio of protrusion streamwise spacing to protrusion hydraulic diameter is 2.0 or less.

Additionally or alternatively, in this or other embodiments the cooling hole inlet is located downstream of a protrusion of the plurality of protrusions, between 0 and 1.5 pedestal hydraulic diameters from the protrusion.

Additionally or alternatively, in this or other embodiments a protrusion of the plurality of protrusions has a circular cross-section.

Additionally or alternatively, in this or other embodiments the one or more cooling holes are configured to divert a portion of the cooling airflow therethrough, to form a cooling film at the outer surface.

Additionally or alternatively, in this or other embodiments the plurality of protrusions include one or more pedestals and/or one or more pin fins.

Additionally or alternatively, in this or other embodiments the component is formed via casting.

Additionally or alternatively, in this or other embodiments the plurality of protrusions and the one or more cooling film holes are formed via a common casting tool.

In another embodiment, a turbine vane for a gas turbine engine includes an outer surface bounding a hot gas path of the gas turbine engine, the outer surface defining an airfoil portion of the vane, and a cooling passage configured to deliver a cooling airflow therethrough. The cooling passage includes a passage wall located opposite the outer surface to define a component thickness and a plurality of protrusions located along the passage wall. Each protrusion has a protrusion height extending from the passage wall and a protrusion streamwise width extending along the passage wall in a flow direction of the cooling airflow through the cooling passage. One or more cooling holes extend from the passage wall to the outer surface. A cooling hole inlet of a cooling hole is located at the passage wall, in a protrusion wake region downstream of a protrusion of the plurality of protrusions.

Additionally or alternatively, in this or other embodiments the plurality of protrusions are arranged in a plurality of rows.

Additionally or alternatively, in this or other embodiments a ratio of protrusion streamwise spacing to protrusion hydraulic diameter is 2.5 or less.

Additionally or alternatively, in this or other embodiments the cooling hole inlet is located downstream of a protrusion of the plurality of protrusions, between 0 and 1.5 protrusion hydraulic diameters from the protrusion.

Additionally or alternatively, in this or other embodiments the one or more cooling holes are configured to divert a portion of the cooling airflow therethrough, to form a cooling film at the outer surface.

Additionally or alternatively, in this or other embodiments the turbine vane is formed via casting.

Additionally or alternatively, in this or other embodiments the plurality of protrusions and the one or more cooling film holes are formed via a common casting tool.

In yet another embodiment, a gas turbine engine includes a combustor section and a turbine section in flow communication with the combustor section. One of the turbine section and the combustor section include a component including an outer surface bounding a hot gas path of the gas turbine engine and a cooling passage configured to deliver a cooling airflow therethrough. The cooling passage includes a passage wall located opposite the outer surface to define a component thickness, and a plurality of protrusions located along the passage wall. Each protrusion has a protrusion height extending from the passage wall and a protrusion streamwise width extending along the passage wall in a flow direction of the cooling airflow through the cooling passage. One or more cooling holes extend from the passage wall to the outer surface. A cooling hole inlet of a cooling hole is located at the passage wall, in a protrusion wake region downstream of a protrusion of the plurality of protrusions.

Additionally or alternatively, in this or other embodiments a ratio of protrusion streamwise spacing to protrusion hydraulic diameter is 2.5 or less.

Additionally or alternatively, in this or other embodiments the cooling hole inlet is located downstream of a protrusion of the plurality of protrusions, between 0 and 1.5 protrusion hydraulic diameters from the protrusion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
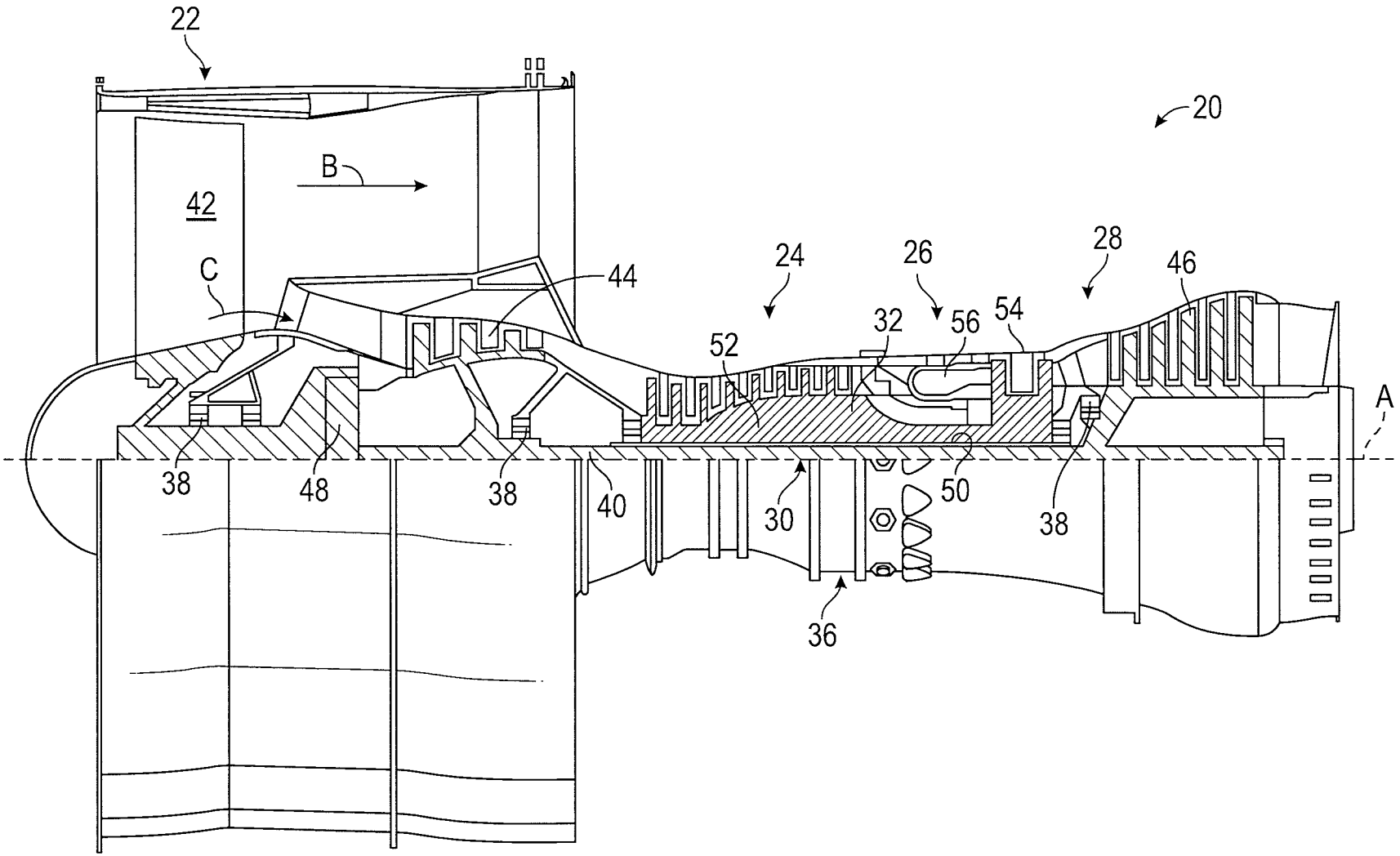
FIG. 1 is a cross-sectional view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
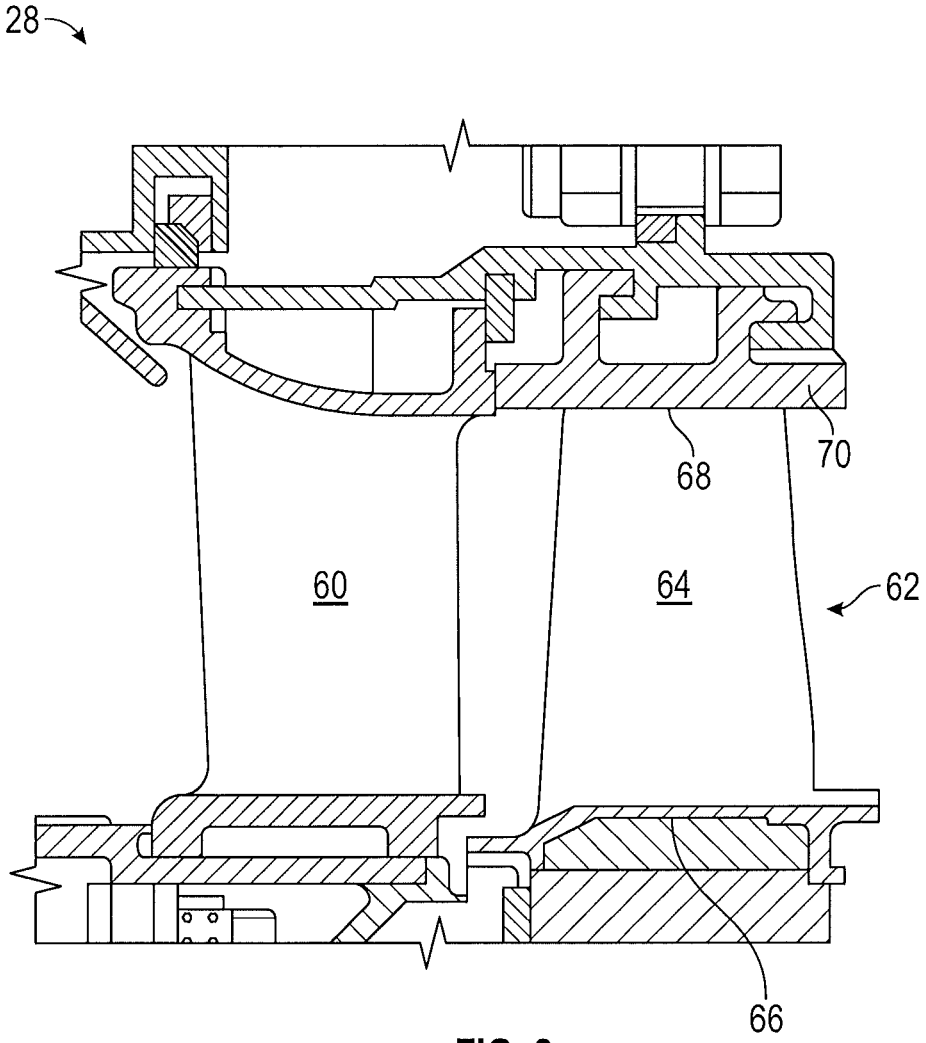
FIG. 2 is a partial cross-sectional view of an embodiment of a turbine section of a gas turbine engine.

Referring now to FIG. 2, the turbine section 28 includes one or more sets, or stages of fixed turbine vanes 60 and turbine rotors 62, each turbine rotor 62 including a plurality of turbine blades 64. The turbine blades 64 extend from a blade platform 66 radially outwardly to a blade tip 68. The blade tip 68 interfaces with a blade outer airseal 70 to maintain minimal operational clearances and thus operational efficiency of the turbine 28. The turbine vanes 60 and the turbine blades 64 utilize internal cooling passages through which a cooling airflow is circulated to maintain the turbine blades 64 and turbine vanes 60 within a desired temperature range. Similarly, other components such as the blade outer airseal 70 may utilize similar cooling channels over which cooling airflow is directed to maintain the component at a desired temperature range, to improve the service life of the component.

Figure 3A:
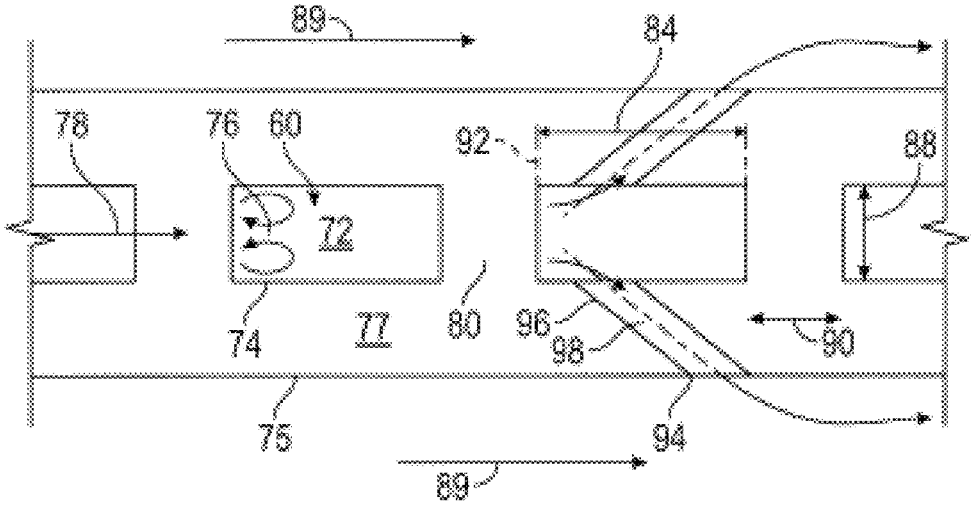
FIG. 3A is a partial cross-sectional view of an embodiment of a gas turbine engine component including one or more pedestals.
Figure 3B:
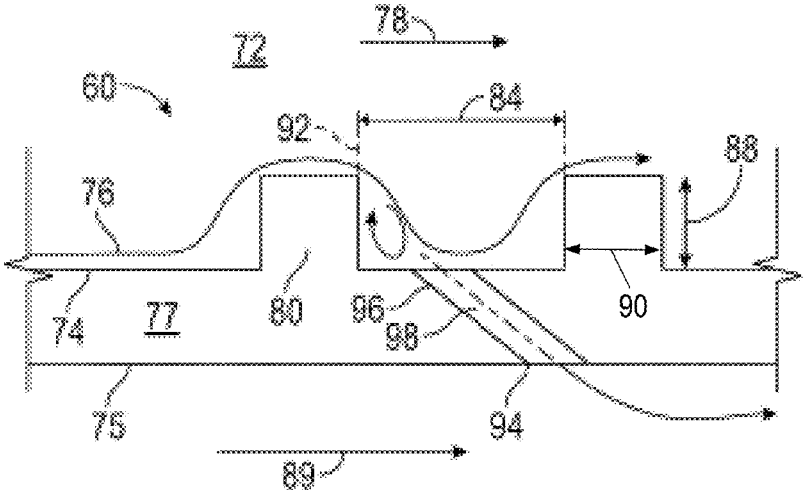
FIG. 3B is a partial cross-sectional view of an embodiment of a gas turbine engine component including one or more pin fins.

Referring now to FIG. 3A, and FIG. 3B shown is a cross-sectional view of an exemplary turbine vane 60. While the description presented herein is in the context of a turbine vane 60, the present disclosure may be readily applied to other components such as turbine blades 64, blade outer airseals 70, inner and outer end walls, combustor panels, or the like. The turbine vane 60 includes a hot exterior wall 77 defined between an external surface 75 exposed to a hot gas path airflow 89, and an internal surface 74 defining an internal cooling passage 72. Cooling airflow 76 flows generally along the internal cooling passage 72 in a flow direction indicated at 78. A plurality of internal protrusions 80 are arrayed along the internal surface 74. In some embodiments, such as shown in FIG. 3A, the protrusions 80 are pedestals extending entirely across the internal cooling passage 72 and thus connected to an internal surface 74 at each end of the pedestal. In other embodiments, such as shown in FIG. 3B, the internal protrusions 80 are pin fins extending only partially across the internal cooling passage 72 and thus are connected to an internal surface 74 at only one end of the pin fin.

The internal protrusions 80, whether they are pedestals or pin fins, induce turbulent mixing in the cooling airflow 76 through the internal cooling passage 72 in order to increase thermal energy transfer between the hot exterior wall 77 and the cooling airflow 76, with the internal protrusions 80 spaced along the internal surface 74 to allow for separation and reattachment of a boundary layer of the cooling airflow 76 at the internal surface 74 for increased thermal energy transfer.

Figure 4A:
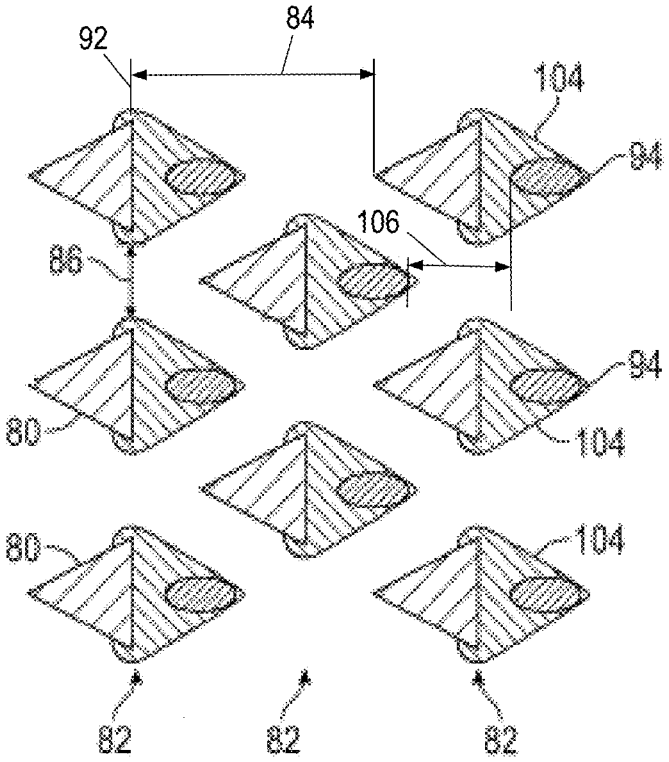
FIG. 4A is a plan view of a pedestal or pin fin arrangement for an embodiment of a gas turbine engine component.
Figure 4B:
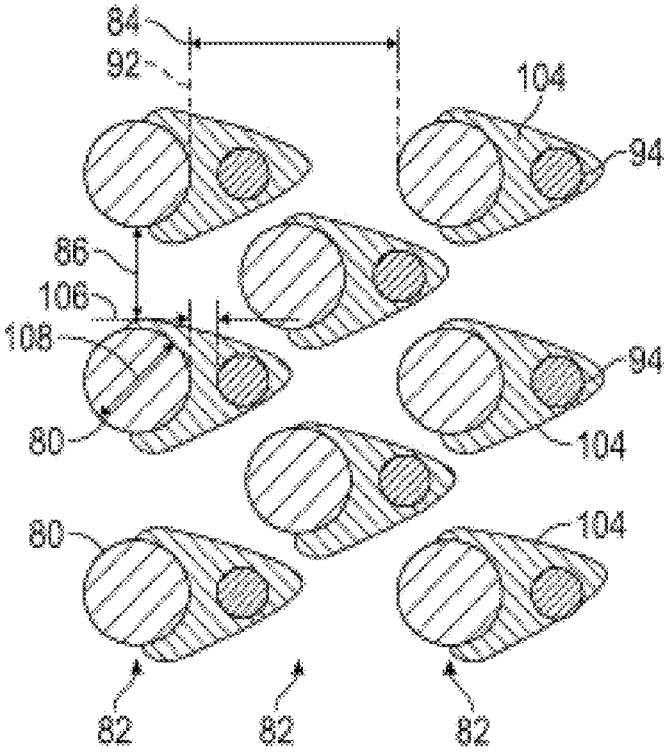
FIG. 4B is a plan view of another pedestal or pin fin arrangement for an embodiment of a gas turbine engine component.
Figure 4C:
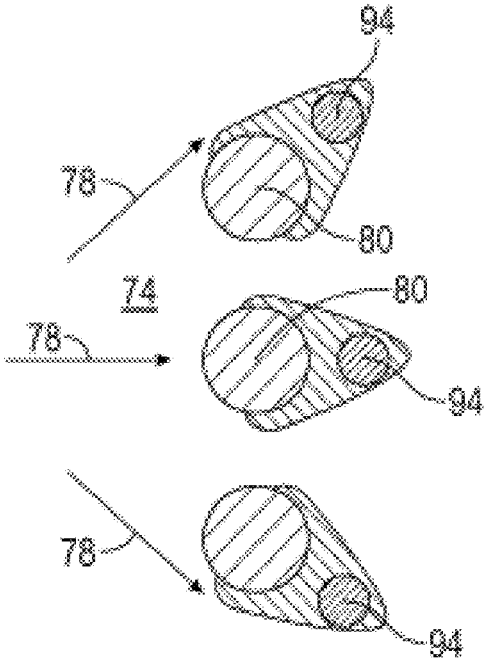
FIG. 4C is a plan view of another pedestal or pin fin arrangement for an embodiment of a gas turbine engine component.

Referring now to FIG. 4, in some embodiments, the internal protrusions 80 are arranged in protrusion rows 82 having a streamwise protrusion spacing 84 between adjacent protrusion rows 82 in a direction parallel to the flow direction 78, measured between closest streamwise portions 92 of the adjacent protrusion rows 82. Further, adjacent protrusions 80 of the same protrusion row 82 are arranged having an off-streamwise spacing 86. In some embodiments, such as shown, the protrusions 80, whether they are pedestals or pin fins, may have a circular cross-section. In other embodiments, the protrusions 80 may have other cross-sectional shapes, such as oval, elliptical, triangular, or other polygonal shape. In still other embodiments, the protrusions 80 may have a combination of the above cross-sectional shapes.

Referring again to FIG. 3A, and FIG. 3B, each protrusion 80 has a protrusion height 88 extending from the internal surface 74 and a protrusion streamwise width 90 extending along the internal surface 74 in the flow direction 78. Further, the hot exterior wall 77 includes a plurality of film cooling holes 94 arrayed along the hot exterior wall 77, and extending therethrough with a film hole inlet 96 at the internal surface 74, and a film hole outlet 98 at an external surface 75 of the hot exterior wall 77, opposite the internal surface 74. In some embodiments the hot exterior wall 77 defines an airfoil portion of the turbine vane 60. The film cooling holes 94 are configured to divert a portion of the cooling airflow 76 from the internal cooling passage 72 to form a cooling film at the external surface 75 to cool the hot exterior wall 75 and protect the hot exterior wall 75 from the hot gaspath airflow 89.

In some embodiments, as best shown in FIG. 4, film cooling holes 94 are located downstream of each protrusion 80, and more specifically the film hole inlet 96 is located in a protrusion wake region 104 downstream of the associated protrusion 80. A protrusion to film hole spacing 106 between the film hole inlet 96 and the protrusion 80 is proportional to a protrusion hydraulic diameter 108. In some embodiments, the protrusion to film hole spacing 106 is between 0 and 1.5 protrusion hydraulic diameters 108.

The location of the film hole inlet 96 in the wake region 104, has the effect of sucking a portion of the cooling airflow 76 from the internal cooling passage 72 to reduce a size of a separation bubble downstream of each protrusion 80 leading to improved reattachment of the boundary layer. With improved reattachment of the boundary layer, the spacing of the protrusions 80 may be reduced. The protrusion streamwise spacing 84 is proportional to the protrusion hydraulic diameter 108, and in some embodiments the protrusion) streamwise spacing 84 is 2.5 protrusion hydraulic diameters 108 or less. Further, while in some embodiments, the streamwise flow direction 78 is uniform as shown in FIG. 4, it is to be appreciated that in some embodiments, as shown in FIG. 4A, the flow direction 78 may locally vary with protrusion 80 location. Thus, different film cooling hole 94 orientations may be utilized to position each of the film cooling holes 94 is the respective wake of their associated or upstream protrusion 80.

Figure 5:
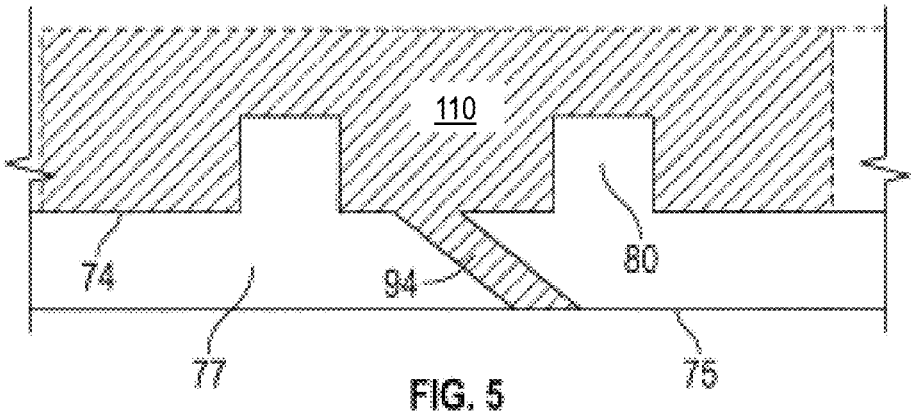
FIG. 5 is a schematic view of a portion of a manufacturing method of a turbine vane.

Referring now to FIG. 5, the film cooling holes 94 and the adjacent protrusions 80 are formed via casting, in some embodiments via a common casting core 110. The formation of the features via casting and via a common casting core 110 provides increased positional accuracy of the features and in a relative position of the film cooling holes 94 and the protrusions 80 compared to a typical process of forming the film cooling holes via a secondary drilling process. The increased positional accuracy of the placement of the protrusions 80 and the film cooling holes 94 assures a selected amount of cooling airflow 76 is flowed through the film cooling holes 94, while the streamwise protrusion spacing 84 may be reduced to improve cooling of the turbine vane 60 via the cooling airflow 76 over the protrusions 80.

The pedestal (pin fin) configurations disclosed herein, with closely-spaced pedestals (pin fins) 80 improves the convective heat transfer and cooling effectiveness of the cooling airflow 76. Thus, the amount of cooling airflow 76 needed may be reduced without negatively effecting turbine vane 60 service life. The reduction in cooling airflow 76 leads to a reduction in thrust-specific fuel consumption (TSFC).

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A component for a gas turbine engine, comprising:

an outer surface bounding a hot gas path of the gas turbine engine;

a cooling passage configured to deliver a cooling airflow therethrough, including:

a passage wall located opposite the outer surface to define a component thickness; and a plurality of protrusions arranged in a plurality of protrusion rows and located along the passage wall, each protrusion having a protrusion height extending from the passage wall and a protrusion streamwise width extending along the passage wall in a flow direction of the cooling airflow through the cooling passage; and a plurality of cooling holes extending from the passage wall to the outer surface, the plurality of cooling holes arranged in a plurality of cooling hole rows, each cooling hole of the plurality of cooling holes having a cooling hole inlet at the passage wall downstream of a protrusion of the plurality of protrusions, wherein the plurality of protrusions and the plurality of cooling holes are arranged in a plurality of pairs, each pair of the plurality of pairs including a protrusion of the plurality of protrusion and a cooling hole of the plurality of cooling holes, each cooling hole of the plurality of cooling holes of a particular cooling hole row located downstream of and associated with a protrusion of a protrusion row located upstream of the particular cooling hole row, a cooling hole of the plurality of cooling holes located downstream of and associated with each protrusion of the plurality of protrusions.

2. The component of claim 1, wherein a ratio of protrusion streamwise spacing to protrusion diameter is 2.5 or less.

3. The component of claim 2, wherein the ratio of protrusion streamwise spacing to protrusion diameter is 2.0 or less.

4. The component of claim 1, wherein each cooling hole inlet is disposed downstream of a protrusion of the plurality of protrusions, between 0 and 1.5 protrusion diameters from the protrusion.

5. The component of claim 1, wherein a protrusion of the plurality of protrusions has a circular cross-section.

6. The component of claim 1, wherein the plurality of cooling holes are configured to divert a portion of the cooling airflow therethrough, to form a cooling film at the outer surface.

7. The component of claim 1, wherein the plurality of protrusions include one or more pedestals and/or one or more pin fins.

8. The component of claim 1, wherein the component is formed via casting.

9. The component of claim 8, wherein the plurality of protrusions and the plurality of cooling holes are formed via the same casting core.

10. A turbine vane for a gas turbine engine, comprising:

an outer surface bounding a hot gas path of the gas turbine engine, the outer surface defining an airfoil portion of the vane;

a cooling passage configured to deliver a cooling airflow therethrough, including:

a passage wall located opposite the outer surface to define a component thickness; and a plurality of protrusions arranged in a plurality of protrusion rows and located along the passage wall each protrusion having a protrusion height extending from the passage wall and a protrusion streamwise width extending along the passage wall in a flow direction of the cooling airflow through the cooling passage; and a plurality of cooling holes extending from the passage wall to the outer surface, the plurality of cooling holes arranged in a plurality of cooling hole rows, each cooling hole of the plurality of cooling holes having a cooling hole inlet at the passage wall downstream of a protrusion of the plurality of protrusions, wherein the plurality of protrusions and the plurality of cooling holes are arranged in a plurality of pairs, each pair of the plurality of pairs including a protrusion of the plurality of protrusion and a cooling hole of the plurality of cooling holes, each film cooling hole of the plurality of cooling holes of a particular cooling hole row located downstream of and associated with a protrusion of a protrusion row located upstream of the particular cooling hole row, a cooling hole of the plurality of cooling holes located downstream of and associated with each protrusion of the plurality of protrusions.

11. The turbine vane of claim 10, wherein a ratio of protrusion streamwise spacing to protrusion diameter is 2.5 or less.

12. The turbine vane of claim 10, wherein each cooling hole inlet is disposed downstream of a protrusion of the plurality of protrusions, between 0 and 1.5 protrusion diameters from the protrusion.

13. The turbine vane of claim 10, wherein the plurality of cooling holes are configured to divert a portion of the cooling airflow therethrough, to form a cooling film at the outer surface.

14. The turbine vane of claim 10, wherein the turbine vane is formed via casting.

15. The turbine vane of claim 14, wherein the plurality of protrusions and the plurality of cooling holes are formed via a common casting tool.

16. A gas turbine engine comprising:

a combustor section; and a turbine section in flow communication with the combustor section;

one of the turbine section and the combustor section including a component including:

an outer surface bounding a hot gas path of the gas turbine engine;

a cooling passage configured to deliver a cooling airflow therethrough, including:

a passage wall located opposite the outer surface to define a component thickness; and a plurality of protrusions arranged in a plurality of protrusion rows and located along the passage wall, each protrusion having a protrusion height extending from the passage wall and a protrusion streamwise width extending along the passage wall in a flow direction of the cooling airflow through the cooling passage; and a plurality of cooling holes extending from the passage wall to the outer surface, the plurality of cooling holes arranged in a plurality of cooling hole rows, each cooling hole of the plurality of cooling holes having a cooling hole inlet at the passage wall downstream of a protrusion of the plurality of protrusions, wherein the plurality of protrusions and the plurality of cooling holes are arranged in a plurality of pairs, each pair of the plurality of pairs including a protrusion of the plurality of protrusion and a cooling hole of the plurality of cooling holes, each film cooling hole of the plurality of cooling holes of a particular cooling hole row located downstream of and associated with a protrusion of a protrusion row located upstream of the particular cooling hole row, a cooling hole of the plurality of cooling holes located downstream of and associated with each protrusion of the plurality of protrusions.

17. The gas turbine engine of claim 16, wherein a ratio of protrusion streamwise spacing to protrusion diameter is 2.5 or less.

18. The gas turbine engine of claim 17, wherein each cooling hole inlet is disposed downstream of a protrusion of the plurality of protrusions, between 0 and 1.5 protrusion diameters from the protrusion.

* * * * *